US007357763B2

(12) United States Patent
Ho

(10) Patent No.: US 7,357,763 B2
(45) Date of Patent: Apr. 15, 2008

(54) CHEST-DEVELOPING EXERCISER

(76) Inventor: Wei-Teh Ho, P.O. Box 24-108, Taipei (TW)

( * ) Notice: Subject to any disclaimer, the term of this patent is extended or adjusted under 35 U.S.C. 154(b) by 0 days.

(21) Appl. No.: 11/068,448

(22) Filed: Feb. 28, 2005

(65) Prior Publication Data

US 2006/0194681 A1 Aug. 31, 2006

(51) Int. Cl.
*A63B 21/00* (2006.01)
*A63B 21/02* (2006.01)

(52) U.S. Cl. ..... 482/132; 482/122; 482/126

(58) Field of Classification Search ..... 482/121, 482/126, 72, 62, 140, 132, 122; D21/694; 135/67

See application file for complete search history.

(56) References Cited

U.S. PATENT DOCUMENTS 5,178,591 A * 1/1993 Lyons ..... 482/52
5,421,795 A * 6/1995 Chen ..... 482/96
5,527,250 A * 6/1996 Chen ..... 482/96
5,584,784 A * 12/1996 Wu ..... 482/95
D394,482 S * 5/1998 Colonello ..... D21/673
5,795,270 A * 8/1998 Woods et al. ..... 482/72
5,997,448 A * 12/1999 Duba ..... 482/121
6,001,051 A * 12/1999 Chuan-Pin ..... 482/131
6,814,690 B1 * 11/2004 Stearns ..... 482/52
D522,076 S * 5/2006 Casey ..... D21/687
2004/0067831 A1 * 4/2004 Hou ..... 482/140

FOREIGN PATENT DOCUMENTS

GB 2110548 A * 6/1983

* cited by examiner

*Primary Examiner*—Fenn C. Mathew
*Assistant Examiner*—Allana Lewin
(74) *Attorney, Agent, or Firm*—Troxell Law Office, PLLC

(57) ABSTRACT

A chest-developing exerciser is disclosed to include a retractable main shaft, a wheel pivotally provided at the bottom end of the main shaft, two handlebars respectively coupled to the top end of the main shaft at two sides, a support bar pivotally connected to a middle part of the main shaft, two foot bars bilaterally provided at the bottom end of the support bar remote from the main shaft, two holder frames respectively fixedly provided at the main shaft and the support bar, and spring members connected between the holder frames.

4 Claims, 6 Drawing Sheets

CHEST-DEVELOPING EXERCISER

BACKGROUND OF THE INVENTION

1. Field of the Invention

The present invention relates to an exercising machine and more particularly, to a chest-developing exerciser for training the muscles of the chest.

2. Description of the Related Art

Various exercising machines have been developed for different exercising purposes, and have appeared on the market. These conventional exercising machines are commonly heavy and expensive. There are chest developers commercially available developers that are compact and inexpensive. However, these chest developers are-to be operated by both hands without exercising the legs.

SUMMARY OF THE INVENTION

The present invention has been accomplished under the circumstances in view. It is the main object of the present invention to provide a chest-developing exerciser, which exercises the muscles of the hands and the chest as well as the legs. It is another object of the present invention to provide a chest-developing exerciser, which is collapsible. It is still another object of the present invention to provide a chest-developing exerciser, which is adjustable to fit different exercising demands According to one aspect of the present invention, the chest-developing exerciser comprises a retractable main shaft, a wheel pivotally provided at the bottom end of the main shaft, two handlebars respectively coupled to the top end of the main shaft at two sides, a support bar pivotally connected to a middle part of the main shaft, two foot bars bilaterally provided at the bottom end of the support bar remote from the main shaft, two holder frames respectively fixedly provided at the main shaft and the support bar, and spring members connected between the holder frames. According to another aspect of the present invention, the support bar can be turned downwardly inwards and closely attached to the main shaft after removal of the spring members from the holder frames. According to still another aspect of the present invention, the user can adjust the number of the spring members to fit different exercising requirements.

DETAILED DESCRIPTION OF THE PREFERRED EMBODIMENT

Figure 1:
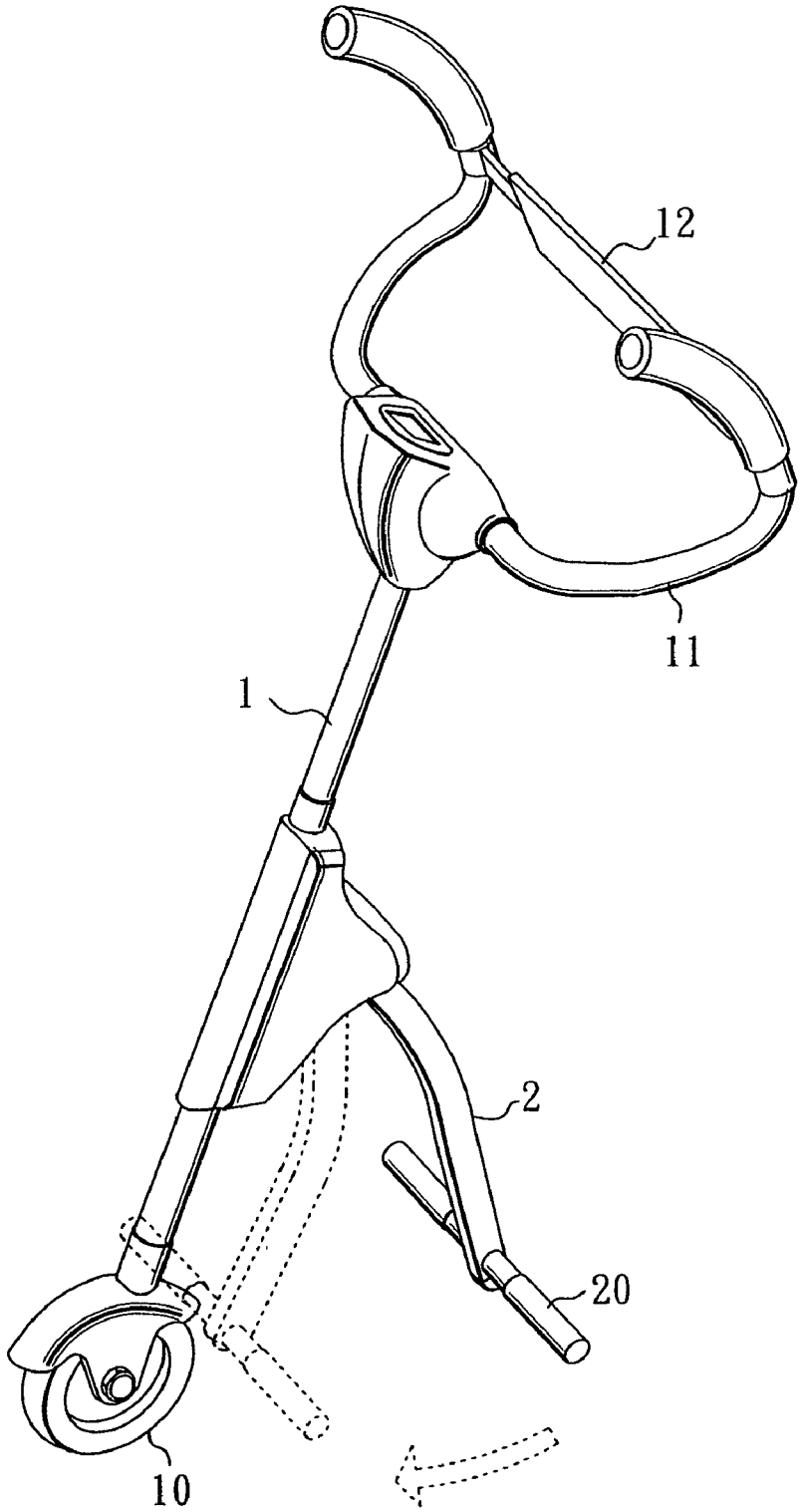
FIG. 1 illustrates a chest-developing exerciser according to the present invention.
Figure 2:
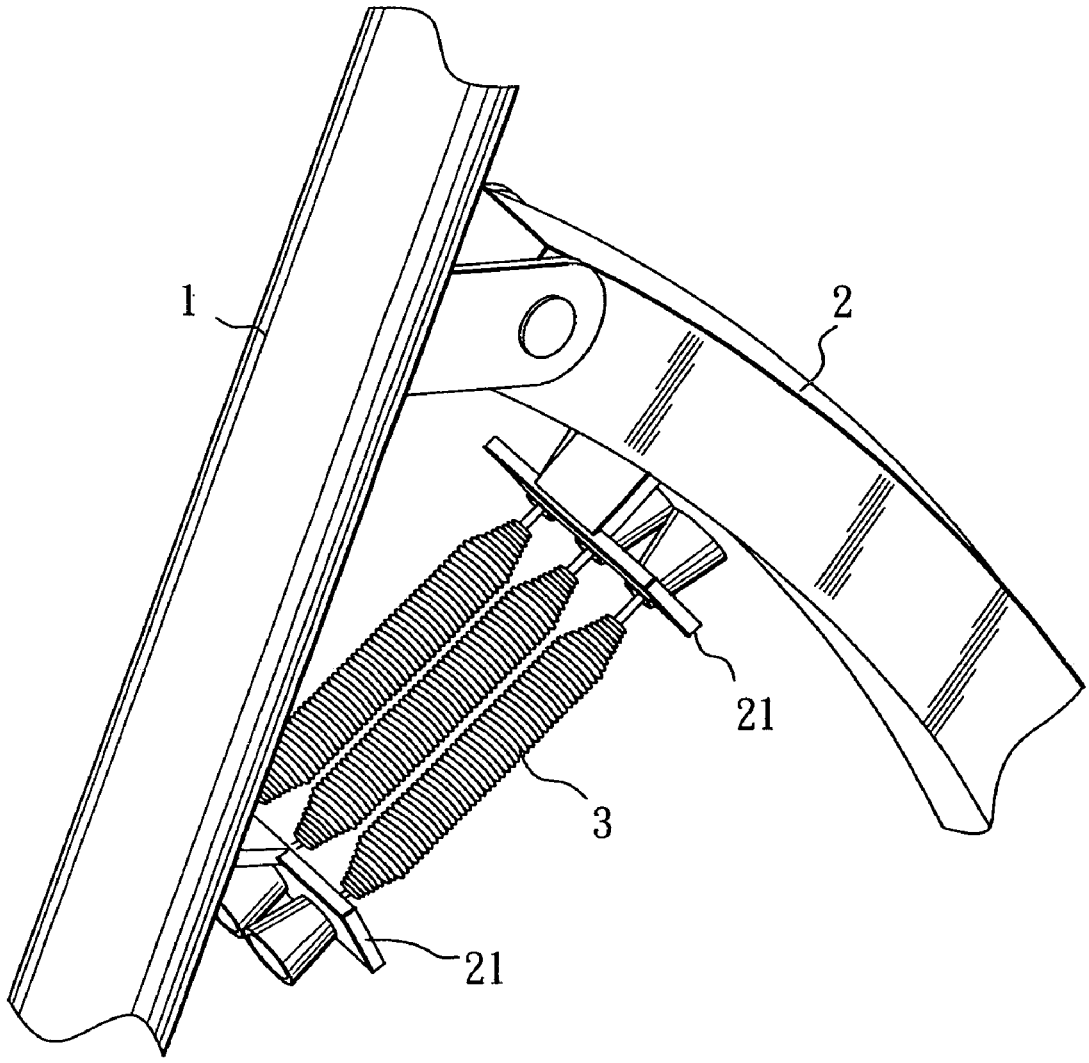
FIG. 2 is an enlarged view of a part of the present invention, showing the positioning of the spring means between the holder frames.
Figure 3:
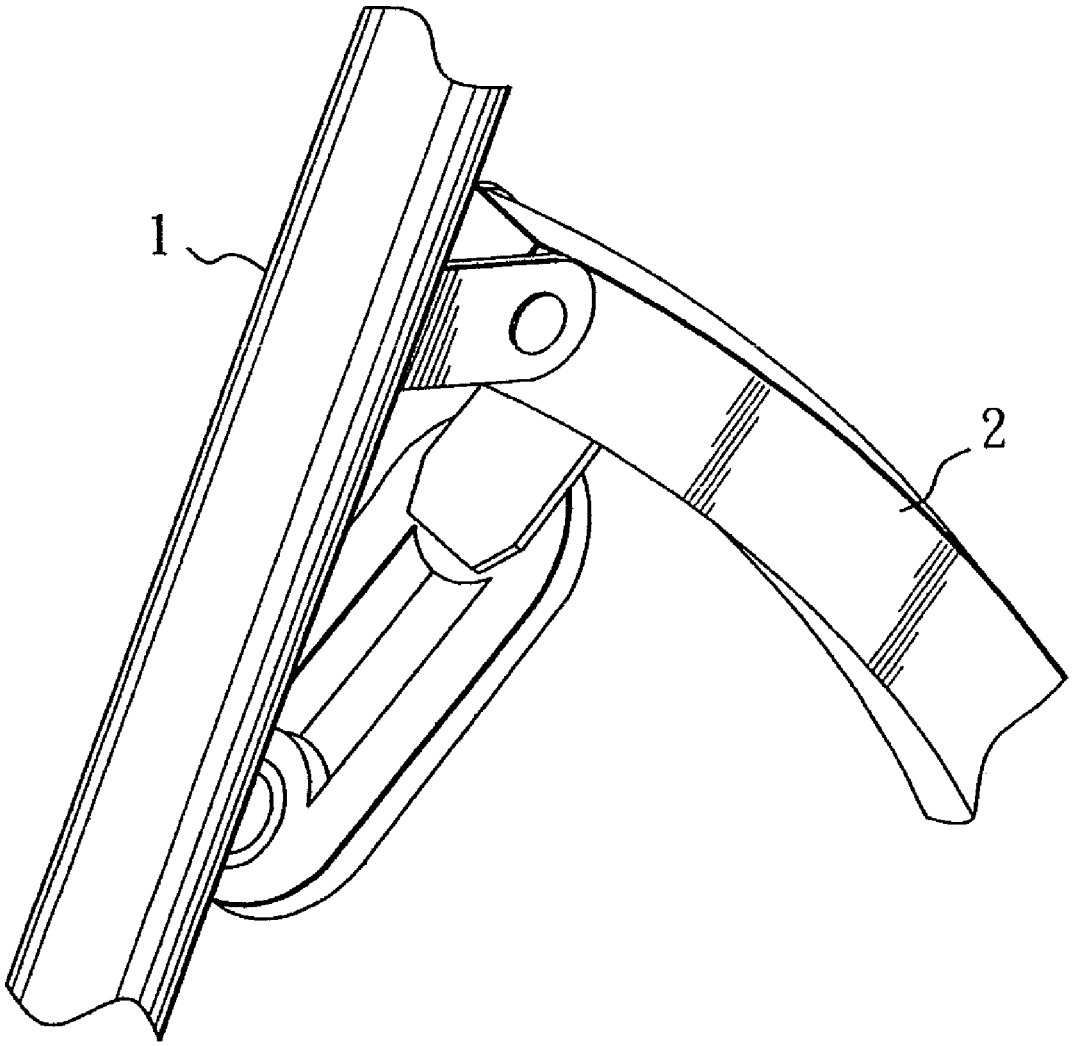
FIG. 3 corresponds to FIG. 2 but showing an alternate form of the spring means.
Figure 4:
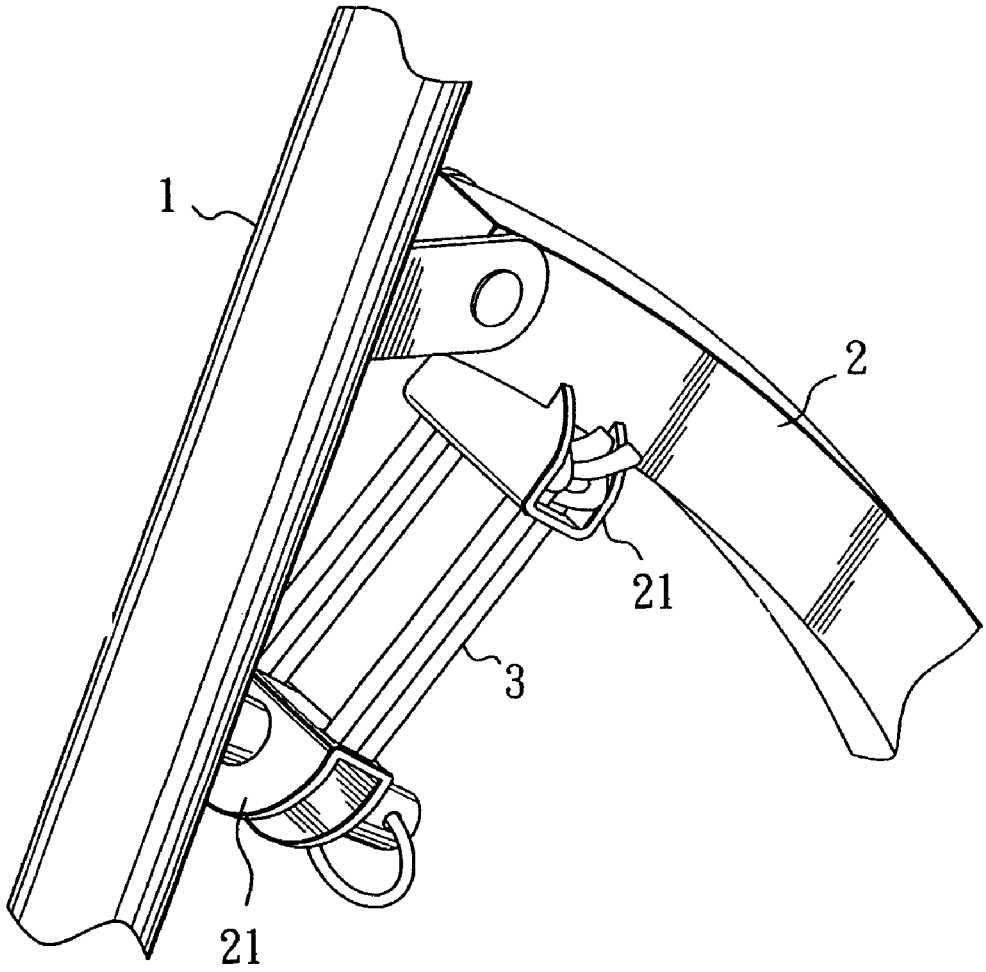
FIG. 4 corresponds to FIG. 2 but showing another alternate form of the spring means.

Referring to FIGS. 1~4, a chest-developing exerciser in accordance with the present invention is shown comprised of a retractable main shaft 1, a wheel 10 pivotally provided at one end, namely, the bottom end of the main shaft 1, two handlebars 11 respectively coupled to the other end, namely, the top end of the main shaft 1 at two sides, a strap 12 connected between the handlebars 11 remote from the main shaft 1, a support bar 2 pivoted to a middle part of the main shaft 1, and two foot bars 20 bilaterally provided at one end, namely, the bottom end of the support bar 2 remote from the main shaft 1, two holder frames 21 respectively provided at the main shaft 1 and the support bar 2, and spring means 3 connected between the holder frames 21. The spring means 3 can be comprised of metal springs (see FIG. 2), elastomer (see FIG. 3), or elastic bands (see FIG. 4).

Figure 5:
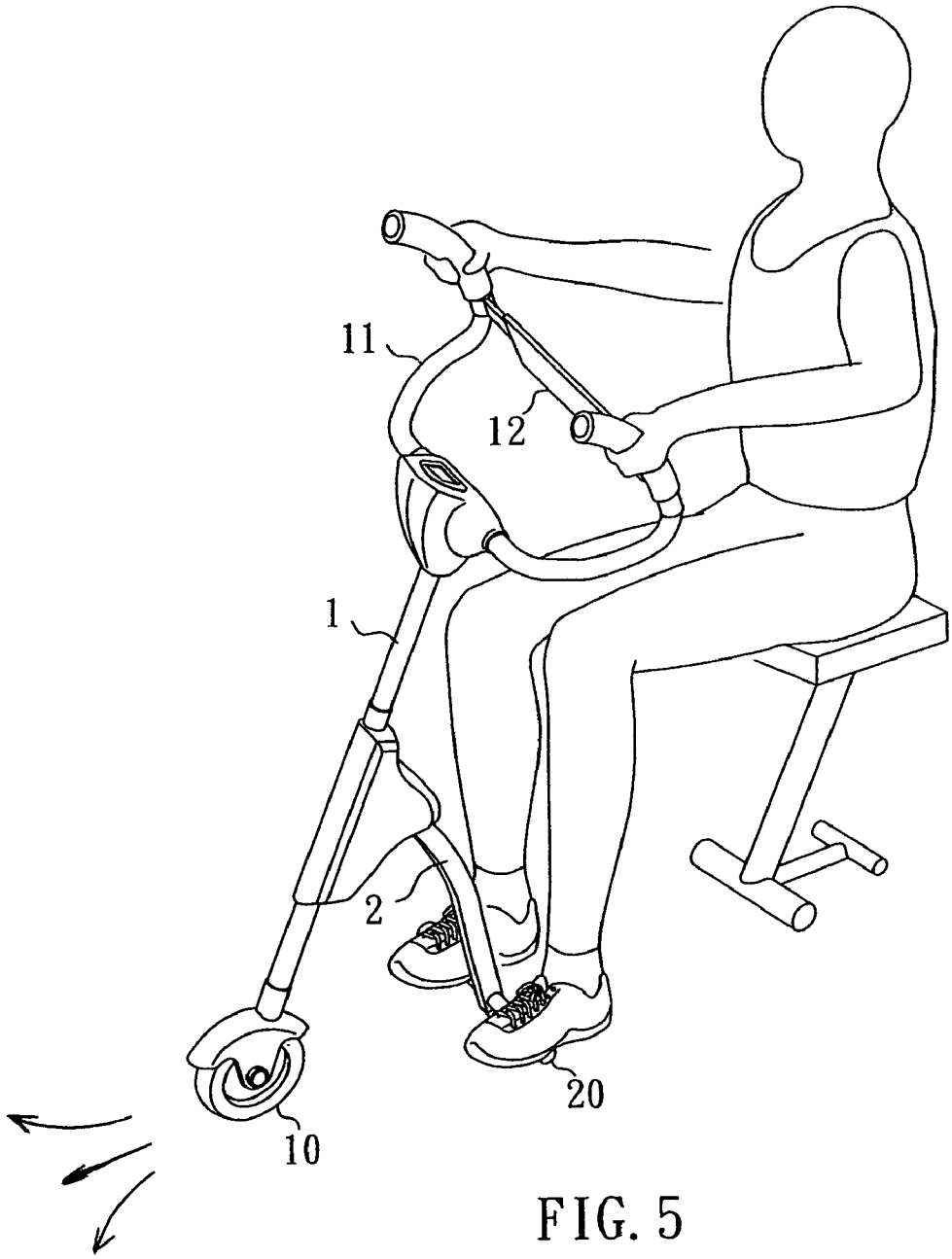
FIG. 5 is a schematic drawing showing an operation status of the present invention.
Figure 6:
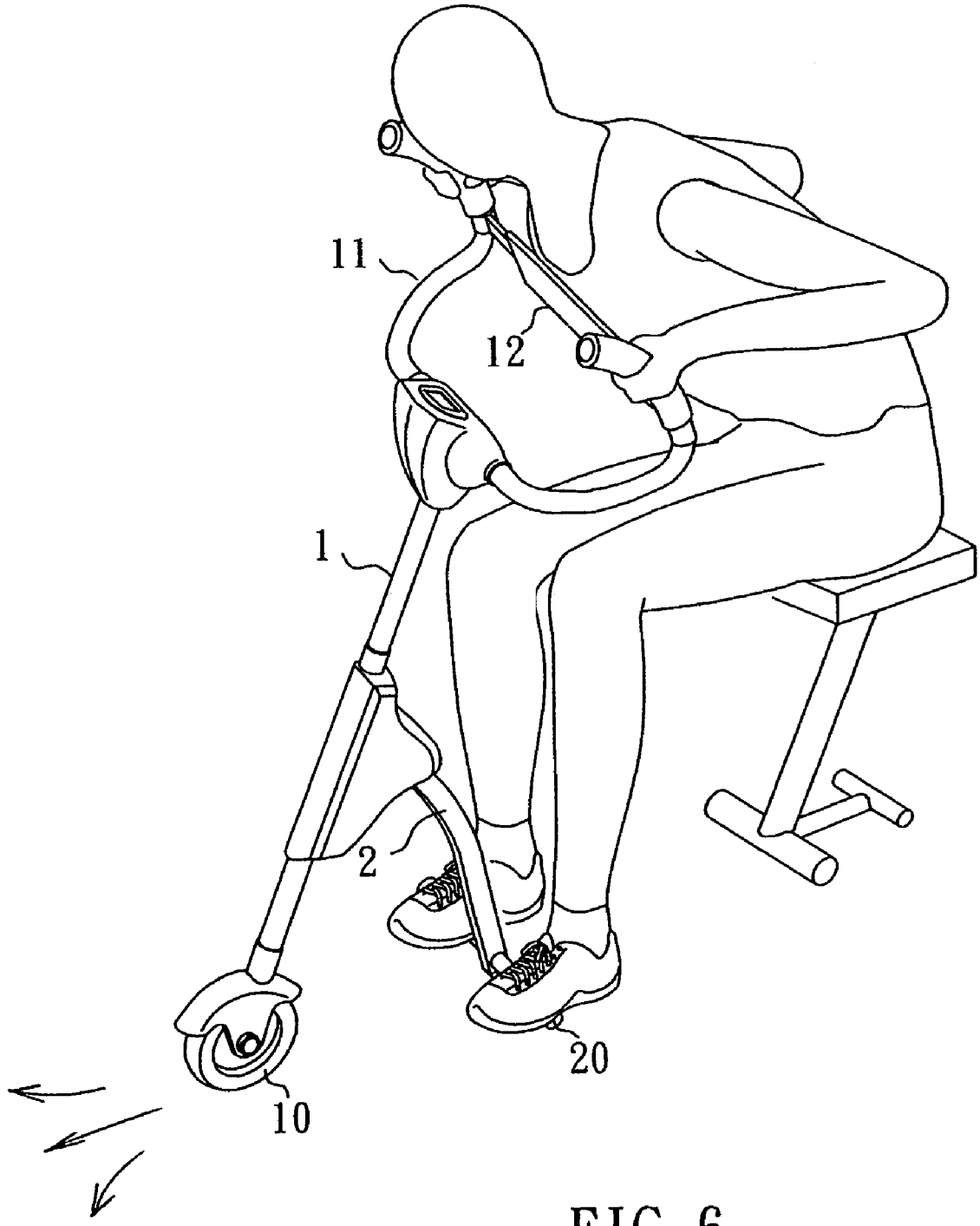
FIG. 6 is a schematic drawing showing another operation status of the present invention.

Referring to FIGS. 5 and 6, when in use, the user can sit on a chair with the hands holding the handlebars 11 and the legs stepped on the foot bars 20, and then turn the upper body alternatively forwards and backwards while employing a pressure to the foot bars 20 through the legs to move the wheel 10 alternatively forwards and backwards on the floor.

Referring to FIGS. 1~4 again, when not in use, the support bar 2 can be turned downwardly inwards and closely attached to the main shaft 1 after removal of the spring means 3 from the holder frames 21.

A prototype of chest-developing exerciser has been constructed with the features of FIGS. 1~6. The chest-developing exerciser functions smoothly to provide all of the features discussed earlier.

Although a particular embodiment of the invention has been described in detail for purposes of illustration, various modifications and enhancements may be made without departing from the spirit and scope of the invention. Accordingly, the invention is not to be limited except as by the appended claims.

What the invention claimed is:

1. A chest-developing exerciser comprising:

a retractable main shaft, said retractable main shaft having a top end and a bottom end;

a wheel pivotally provided at the bottom end of said main shaft, said wheel being linear to said shaft and said bottom end being configured to allow rotation of said wheel about an axis formed by said main shaft, the wheel being positioned to roll backwards and forwards across a walking surface when the chest-developing exerciser is in use by a user;

two handlebars respectively coupled to the top end of said main shaft at two sides;

a support bar, said support bar having a top end pivotally connected to a middle part of said main shaft and a bottom end;

two foot bars bilaterally provided at the bottom end of said support bar, two holder frames respectively fixedly provided at said main shaft and said support bar; and spring means connected between said holder frames.

2. The chest-developing exerciser as claimed in claim 1, wherein said spring means is comprised of a plurality of metal spring members.

3. The chest-developing exerciser as claimed in claim 1, wherein said spring means is comprised of a plurality of elastic bands.

4. The chest-developing exerciser as claimed in claim 1, further comprising a strap connected between said handlebars remote from said main shaft.

* * * * *